US006554322B2

(12) United States Patent
Duong et al.

(10) Patent No.: US 6,554,322 B2
(45) Date of Patent: Apr. 29, 2003

(54) CONTROLLER VALVE COUPLING

(76) Inventors: Thach Duong, 10540 N. Lakeside Dr., #F, Garden Grove, CA (US) 92840; Raymond-Paul Joubran, 2345 Galbreth Rd., Pasadena, CA (US) 91104; Joseph Raffaelli, 1020 Descanso Dr., La Canada, CA (US) 91011; Kenneth N. Minkler, 13055 Ardis Ave., Downey, CA (US) 90242

( * ) Notice: Subject to any disclaimer, the term of this patent is extended or adjusted under 35 U.S.C. 154(b) by 0 days.

(21) Appl. No.: 09/862,745

(22) Filed: May 21, 2001

(65) Prior Publication Data

US 2002/0171241 A1 Nov. 21, 2002

(51) Int. Cl.[7] ..... F16L 37/00

(52) U.S. Cl. ..... 285/305; 285/321; 285/276; 285/201

(58) Field of Search ..... 285/321, 201, 285/204, 202, 305, 276, 93; 73/40, 40.7, 46, 49.1, 49.2, 49.3; 122/13.01, 14.1, 19.2

(56) References Cited

U.S. PATENT DOCUMENTS 3,314,696 A * 4/1967 Ferguson et al. ..... 285/305
4,635,974 A * 1/1987 Moussaian ..... 285/305
4,873,870 A * 10/1989 Delatorre ..... 361/283.2
4,884,829 A * 12/1989 Funk et al. ..... 285/24
5,261,438 A 11/1993 Katchka
5,348,037 A 9/1994 Katchka
5,419,356 A 5/1995 Katchka
5,620,016 A 4/1997 Katchka
5,964,483 A * 10/1999 Long et al. ..... 285/305
6,182,944 B1 * 2/2001 Veronese et al. ..... 137/335
6,371,057 B1 * 4/2002 Henderson ..... 122/14.2
6,371,528 B1 * 4/2002 Kimura ..... 285/305

FOREIGN PATENT DOCUMENTS

JP 5-33891 * 9/1993

* cited by examiner

*Primary Examiner*—Eric K. Nicholson
*Assistant Examiner*—Aaron Dunwoody
(74) *Attorney, Agent, or Firm*—Blackwell Sanders Peper Martin LLP

(57) ABSTRACT

A mechanism for attaching a gas controller to a water heater includes a shank that is longitudinally received in a spud attached to the water heater. O-rings serve to form a water tight seal between the interior surface of the spud and the exterior surface of the shank. Slots formed in the spud and a groove formed in the shank allow the two components to be axially locked to one another with the insertion of a retainer spring clip. The spring clip is readily removable to allow the two components to be separated without the destruction of any components.

17 Claims, 4 Drawing Sheets

CONTROLLER VALVE COUPLING

BACKGROUND OF THE INVENTION

The present invention generally relates to controller valves that are used to regulate the water temperature within a water heater and more particularly pertains to the mechanism by which such controller valve is attached to a water heater.

Controller valves are fitted to water heaters to perform a number of functions. In addition to sensing the water temperature within the water heater, the controller allows a set temperature to be selected, controls the flow of gas to the burner so as to maintain the water temperature at or near the set temperature and facilitates the ignition of the burner whether by pilot flame, or by electric or electronic means. Additionally, the device monitors the existence of a burner flame or pilot flame with the use of a thermocouple and/or thermopile for the purpose of shutting down the flow of gas in the event the gas fails to ignite or in the event an established flame becomes extinguished. Such controller device is typically situated on the exterior of the water heater so as to be readily accessible to allow a set temperature to be selected and in the event a pilot flame ignition system is employed, to allow manual valves to be operated during the start-up procedure. Additionally, the device includes a temperature sensor, usually in the form of an Invar rod/copper sleeve combination that extends into the interior of the water heater to sense water temperature directly. A conduit that supplies gas to the burner extends from the controller to the burner and in the event a pilot flame is relied upon for ignition, a second gas carrying conduit extends from the controller to supply gas to such pilot flame. Additionally, one or more electrical conductors may extend from the controller including interconnections to thermoccouples and/or thermopiles and to electric or electronic ignitors if present.

Gas controllers have typically been attached to water heaters via a threaded interconnection between the controller and a fitting that is welded or otherwise permanently attached to the wall of the water tank and through which the Invar rod type sensor is extended into the interior of the water tank. A number of problems are inherent in such configuration including for example the need to apply a substantial torque load to the controller in order to achieve a water tight interconnection with the threaded fitting. This is further complicated by the necessity to achieve a proper rotational orientation of the controller valve while simultaneously avoiding an over-tightening or under-tightening of the connection. Additionally, because any rigid or semi-rigid conduits that extend from the controller would physically interfere with the structure of the water heater during the threading of the controller into place if such conduits were to be attached to the controller prior to its attachment to the water heater, the preassembly of such components to the controller is precluded. This in turn precludes the testing of such assembly prior to installation on the water heater. A leak or other malfunction that is discovered after the attachment of the controller to the water heater and the attachment of all the various conduits and wires thereto requires a labor intensive effort to disassemble, repair and reassemble the entire system on and in the water heater. A need to remove the controller for repair requires reapplying potentially damaging torque loads to the controller in order to remove it from the threaded fitting and again for refitment after its repair.

It has previously been recognized that the ability to attach such controller to a water heater without the need to rotate the device into place overcomes a number of shortcomings inherent in the previously used configurations that rely on a threaded interconnection. Mechanisms have been devised which merely require longitudinally pushing the controller into a fitting positioned on the side of the water heater. In such configurations, the Invar rod-type sensor extends through the fitting into the interior of the water heater while a shank element surrounding the base of the sensor is received in an appropriately configured spud. The spud in turn is received in the internally threaded fitting that is conventionally and permanently mounted in the wall of the water tank. One or more O-rings positioned within grooves formed on the interior wall of the spud are relied upon to form a water tight seal against the exterior surface of the shank upon its insertion there into. Full insertion serves to align a groove formed about the interior surface of the spud and a groove formed about the exterior surface of the shank. An flexible retainer clip positioned within the groove formed on the shank is then free to expand into the groove formed in the spud to thereby positively lock the two components to one another. By obviating the need to rotate the controller into place, the controller along with all conduits extending therefrom can be preassembled and pretested. Any repairs or remediation efforts that may be deemed necessary as a result of the pretesting can be performed before the assembly is installed on and in the water heater, thus providing substantially more accessibility and freedom of movement to effect the repair. Additionally, such configuration obviates the need to exert any torque on the controller while allowing the controller to assume a proper rotational orientation. A number of such devices have previously been described as for example in U.S. Pat. Nos. 5,419,356 and 5,620,016.

The described mounting mechanisms do however suffer from a number of shortcomings. One such shortcoming is the fact that once the shank has been fully inserted into the spud and the retainer spring clip has expanded to lock the two components together, the components cannot be separated without destruction of the spud. The inaccessibility of the internally disposed spring clip precludes manipulation thereof in effort to release the shank from the spud while unthreading of the spud from the fitting leaves the spud in a distorted and unreuseable state. Reuse of the controller requires the complete destruction of the spud in order to free it from the retainer clip. Moreover, in order to initially remove the controller from the water heater, all of the conduits and connections to the controller must be disconnected in order to allow the spud, along with the attached controller, to be unthreaded from the fitting that is attached to the side of the water heater. This requires a substantial torque to be exerted on the controller, especially if the spud has been in place for an extended period of time, which may cause the controller to become irreparably damaged. If the controller is to be reused, the fairly labor intensive effort to remove the old spud must first be expended, after which a new spud must be threaded onto the fitting on the side of the water heater. The spud must be brought into a precise rotational orientation in order to ensure that the controller that is to be fitted thereto is properly aligned with the various conduits from which it had been previously detached. Additionally, it has been found that the O-rings that are disposed within the grooves formed on the interior of the spud are prone to being displaced upon insertion of the shank which may result in their being damaged which could in turn prevent an effective seal from being achieved. Replacement of the O-rings requires removal of the controller and destruction of the spud as described above.

An improved controller valve attachment mechanism is therefore needed that allows the controller to be attached to the water heater by simple longitudinal receipt within a spud attached to the water heater, that forms the requisite water tight seal with the water heater yet allows the controller to be removed without disassembly of the conduits extending therefrom. Additionally it is desirable that such controller should be refittable without the sacrifice of any of the components. Finally, a configuration is needed wherein O-rings are less susceptible to damage.

SUMMARY OF THE INVENTION

The present invention overcomes the shortcomings of previously known controller valve attachment mechanisms. The invention allows a controller valve to be attached to a water heater by simply pushing a shank extending from the controller onto a spud that is threadedly attached to the wall of the water heater. The shank can then be reversibly locked into place with the use of an externally applied retainer spring clip while the O-rings relied upon to effect a seal are substantially protected from damage during assembly. The configuration allows the controller and the various conduits extending therefrom to be preassembled and pretested prior to installation on a water heater. Moreover, should it become necessary to subsequently remove the controller for repair or replacement, such task is easily accomplished with minimal effort and no destruction of any parts.

The attachment mechanism of the present invention includes a shank that extends from the back of the controller and surrounds the base of Invar rod-type temperature sensor. The shank includes a groove formed on the exterior surface of proximal section near its base. Such proximal section has a diameter slightly greater than its distal section. Two grooves formed on the distal section of reduced diameter carry two O-rings which are dimensioned so as to be under slight tension. A spud is threaded onto the fitting that is in turn permanently attached to the wall of the water heater. A pair of diametrically opposed slots are formed in the spud that extend completely through its wall thickness. Such slots are positioned so as to be in alignment with a groove formed about the proximal section of the shank to allow the insertion of a retainer spring clip which serves to lock the shank and spud to one another. Removal of the spring, which is readily accessible, allows the shank to be retracted from the spud.

In one embodiment, the shank, and hence the controller, is freely rotatable with respect to the spud. In another embodiment, cooperating surfaces on the spud and shank serve to rotationally lock the two components together.

These and other features and advantages of the present invention will become apparent from the following detailed description of a preferred embodiment which, taken in conjunction with the accompanying drawings, illustrates by way of example the principles of the invention.

DETAILED DESCRIPTION OF THE PREFERRED EMBODIMENTS

The figures generally illustrate a embodiments of the gas controller device of the present invention that includes a mounting mechanism which allows the controller to be mounted to a water heater by simply pushing it into place. The controller may therefore be preassembled and pretested prior to its to the water heater. Moreover, the mounting mechanism allows the controller to be subsequently removed without the need to damage or sacrifice any of its components.

Figure 1:
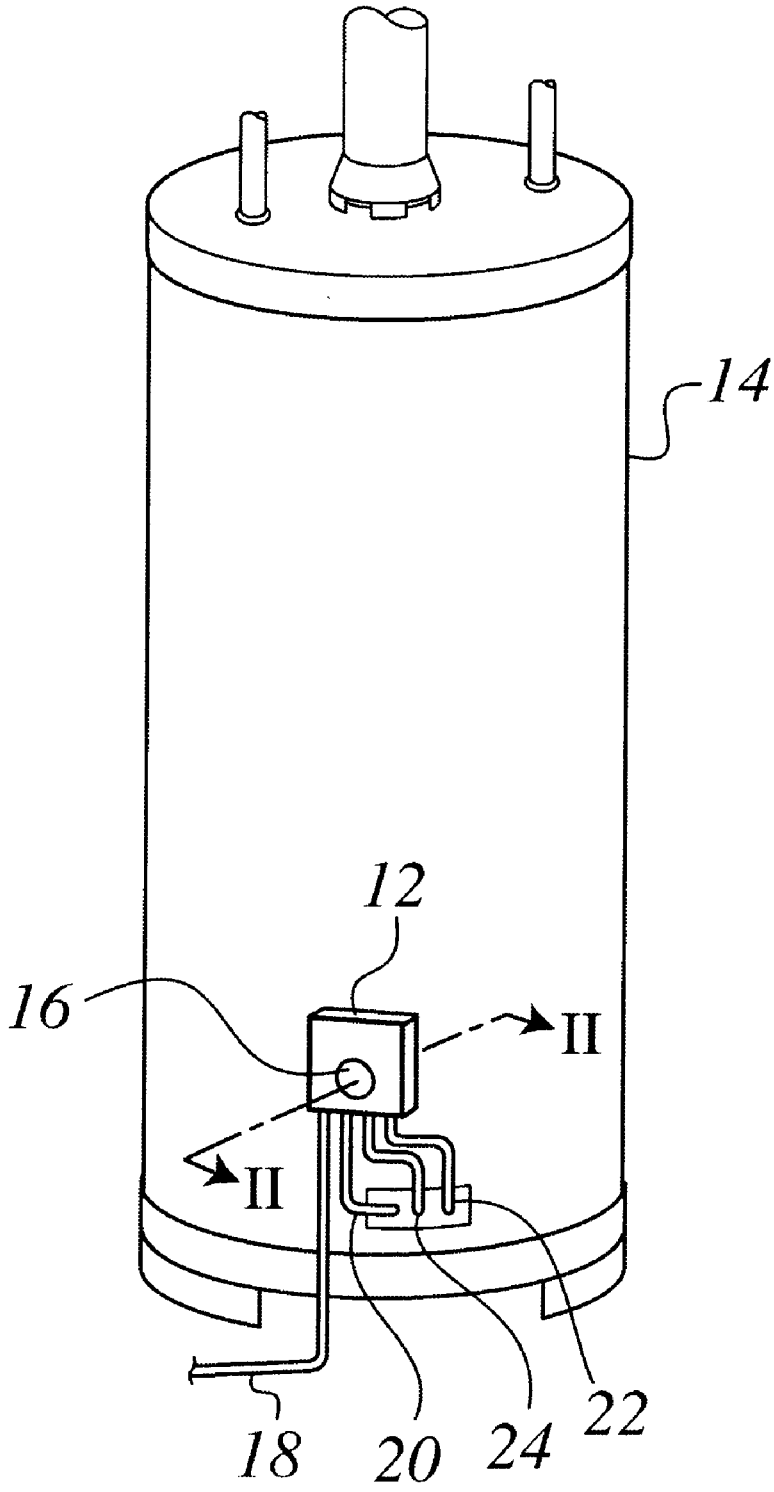
FIG. 1 is perspective view of the gas controller of the present invention attached to a water heater.

FIG. 1 is a perspective view of the gas controller 12 of the present invention mounted to the side of a water heater 14. The gas controller includes a dial 16 with which a set temperature can be selected. Additionally visible is a gas feed line 18 by which a gaseous fuel is supplied to the controller. A gas conduit 20 extends from the controller to the burner (not visible) situated directly below the water tank. Additionally visible are several wires 22 that extend from the controller into the area below the tank. Such wires may connect to thermocouples and/or thermopiles in addition to an electric or electronic starter. In the event the water heater relies on a pilot flame to light the burner, an additional conduit 24 will extend from the controller into the burner area. The gas controller operates in the conventional manner to regulate the flow of gas to the burner as needed in order maintain a desired set temperature, monitors the existence of a flame and facilitates the ignition of the burner.

Figure 2:
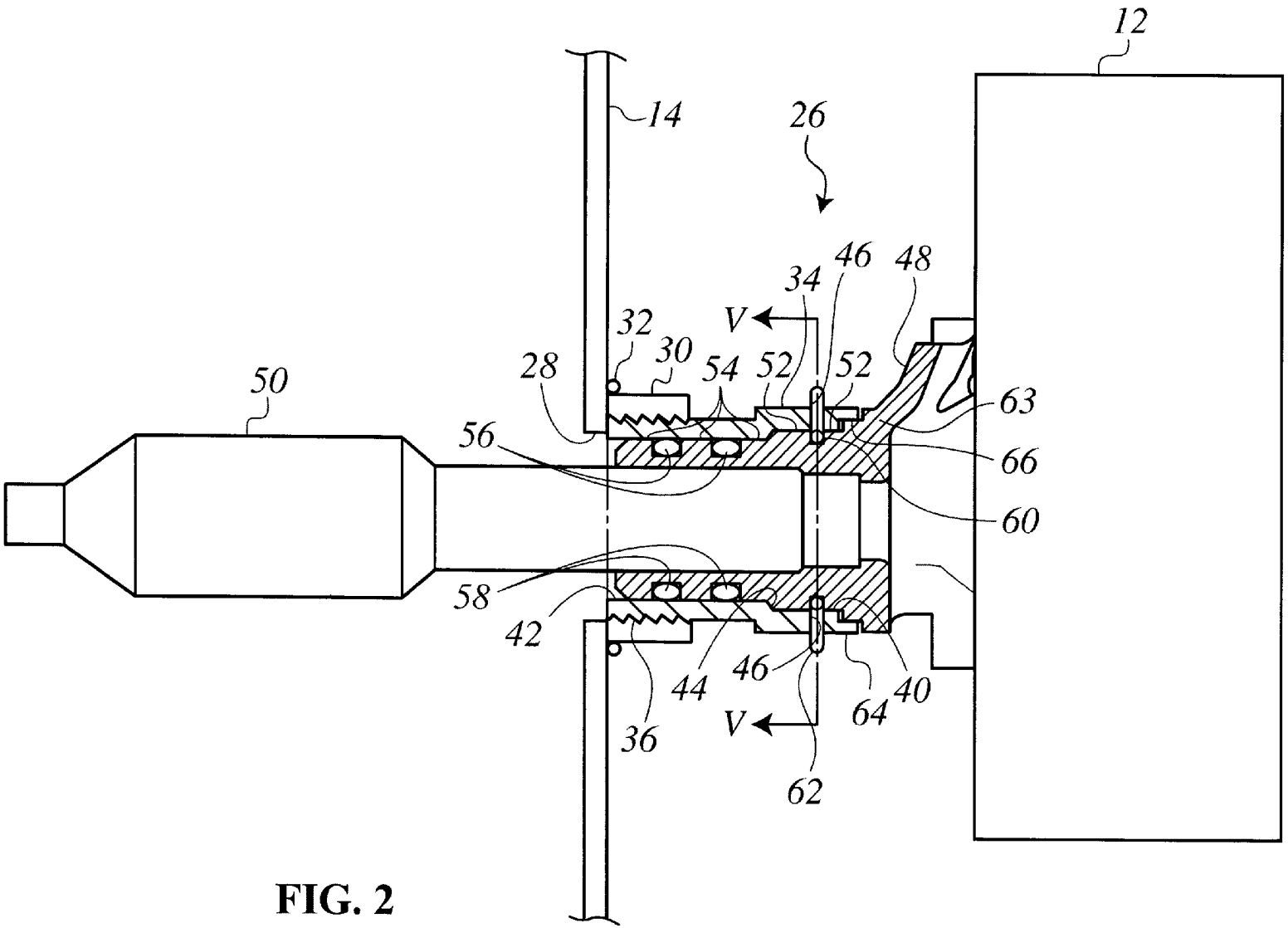
FIG. 2 is an enlarged cross-sectional view taken along lines II—II of FIG. 1.

FIG. 2 is a cross sectional view of the controller 12 illustrating the mechanism 26 by which the controller is attached to the side of the water heater 14. An opening 28 formed in the wall of the water heater 14 is surrounded by an internally threaded fitting 30 which is attached to the wall in a water tight manner such as by a weld 32. A spud 34, having an externally threaded surface 36, is received in the fitting. A bore38 formed in the interior of the spud has a proximal section 40 of increased internal diameter and a distal section 42 of reduced internal diameter with a chamfered transition 44 there between. A pair of diametrically opposed slots 46 are formed in spud near its proximal end and extend from its exterior surface completely through to its interior surface. The controller 12 has a shank 48 attached thereto and positioned so as to surround the base of the Invar rod temperature sensor 50. The shank has a stepped outer surface including a proximal section of increased outer diameter 52 and a distal section of reduced outer diameter 54. One or more circumferential grooves 56 are formed on the surface of the distal section of reduced diameter 54, each being dimensioned to support an O-ring 58 under slight tension. Another circumferential groove 60 is formed on the surface of the proximal section of increased diameter 52, positioned so as to be in alignment with the slots 46. A retainer spring clip 62 is positioned within slots 46 to extend into groove 60. Also visible in this illustration is a portion of a squared off lip 64 extending from the proximal end of the spud that cooperates with a squared off section 66 of the base of the shank to rotationally lock the two components to one another.

Figure 3:
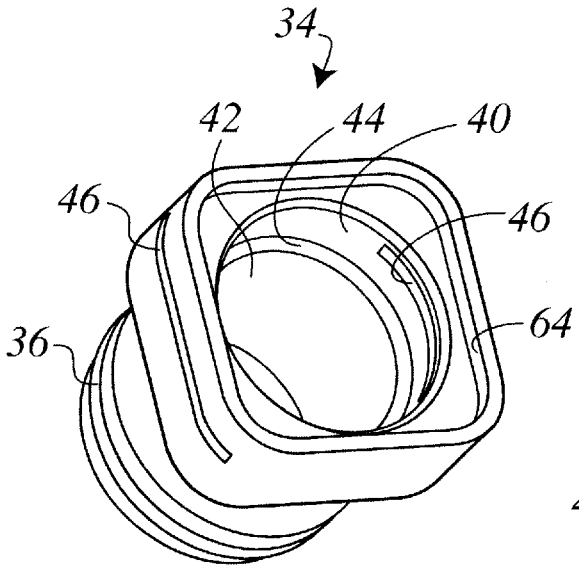
FIG. 3 is an enlarged perspective view of the spud component of the preferred embodiment shown in FIG. 2.
Figure 4:
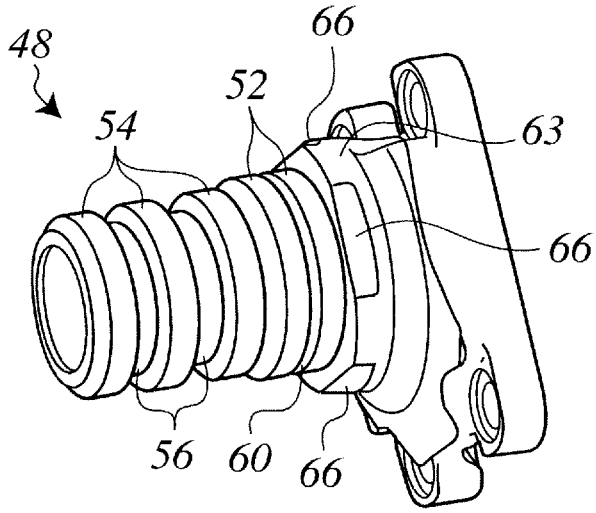
FIG. 4 is an enlarged perspective view of the shank component of the preferred embodiment shown in FIG. 2.

FIGS. 3 and 4 are enlarged perspective views of the spud 34 and shank 48 components of the preferred embodiment shown in FIG. 2. Clearly visible in FIG. 3 are the external threads 36 formed on the exterior surface of the spud which are received in the internally threaded fitting 30 that is attached to the wall of the water heater 14. Also clearly visible are the two diametrically opposed slots 46 formed near the proximal end of the spud along with the various sections of the bore extending there through including the proximal section of increased diameter 40, the chamfer 44 and the distal section of decreased diameter 42. Additionally visible is the squared off lip 64 that extends about the periphery of the proximal end of the spud.

Clearly visible in FIG. 4 are the features formed on the external surface of the shank 48 including the proximal section of increased diameter 52 and the distal section of reduced diameter 54. Formed in the section of reduced diameter are the two grooves 56 dimensioned to received the O-ring seals. The groove 60 formed on the proximal section of increased diameter is dimensioned and positioned so as to receive a retainer clip 62 extending through the slots 46 in the spud. Finally, the squared off surfaces 66 formed on base 63 of the shank are visible. Such surfaces are dimensioned and positioned so as to cooperate with the raised lip 64 formed on the spud to rotationally lock the two components to one another.

Figure 5:
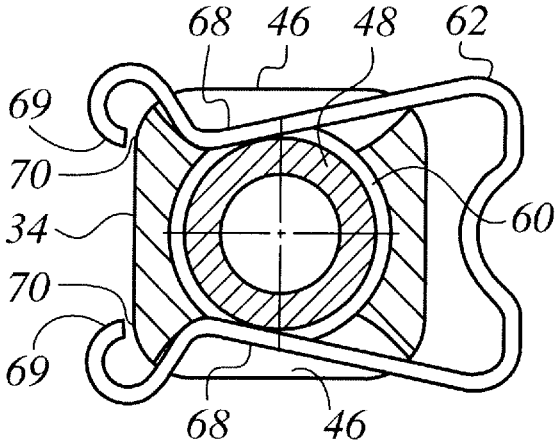
FIG. 5 is an enlarged cross-sectional view taken along lines V—V of FIG. 2.

FIG. 5 is an enlarged cross-sectional view taken along lines V—V of FIG. 2 to illustrate the interaction of the spud 34, shank 48 and retainer clip 62 to axially lock the components to one another. Upon full insertion of the shank into the spud, the slots 46 of the spud become aligned with the groove 60 formed in shank's proximal section of increased diameter 52. The prongs 68 of the retainer clip are biased towards one another and upon insertion into the slots 46 engage the bottom of groove 60. The opposed walls of the groove 60 as well as the opposed walls of the slots 46 both prevent axial movement of the clip 62 to thereby axially lock the spud 34 to the shank 48. Each prong terminates in a curved end 69 that is dimensioned so as to reside adjacent to an unslotted portion 70 of the outer surface of the spud. Such feature prevents the retainer spring clip from inadvertently being dislodged. An appropriate tool must be used to either apply sufficient pulling force on the retainer clip to force it out of the groove and slots or spread the prongs so as to clear the unslotted portion of the outer surface of the spud.

In use, the shank 48 extending from controller 12 is simply pushed into the spud 34 that has previously been threaded onto a fitting that had in turn been attached to the wall of the water heater 14. The square cross-section of the external surface of the spud proximal to the threads allows a wrench to applied thereto enable sufficient torque to be applied thereto to form a water tight seal with the fitting. The positioning of the O-rings 58 on the shank rather than in the spud allows the O-rings to dimensioned so as to be in slight tension thereby serving to positively maintain them in place. Additionally, their position on the shank allows them to be readily inspected by the assembling technician for any damage and easily replaced if required. The increased internal diameter of the proximal section 40 of the spud, precludes contact between the O-rings 58 and slots 46 formed in the spud and thereby precludes any damage that may otherwise be inflicted by the edge of a slot on the soft seal material. As the shank is pushed further into the spud, the slight tension the O-rings are under ensures that their positions within their respective grooves are maintained as they become compressed by the chamfered step 44 between the spud's proximal section 40 and distal section 42. As the shank is further extended into the spud, the raised lip 64 on the proximal end of the spud forces the shank to be rotationally aligned to allow the lip to engage squared off surfaces 66 and become fully seated on the base 63. Once fully seated, the shank is rotational locked in place by the cooperation of the raised lip 64 and the squared off sections 66 of the base of the shank. Additionally, full insertion causes the slots 46 in the spud to be aligned with the groove 60 formed in the proximal section of the shank. Insertion of the prongs 68 of clip 62 into the slots 46 serves to axially lock the shank to the spud to complete the assembly process. The bias of the prongs 68 toward one another maintain them in firm engagement with the base of the groove 60 while the interference of the inwardly direct prong ends 69 with the unslotted portion of the surface of the spud prevent the clip from inadvertently being dislodged. In the event it is necessary to subsequently remove the controller from the water heater, it is a simple matter of extracting the retainer spring clip 62 with the appropriate tool to release the shank from the spud. No damage to the spud, shank or O-rings occurs as a result of removal.

Figure 6:
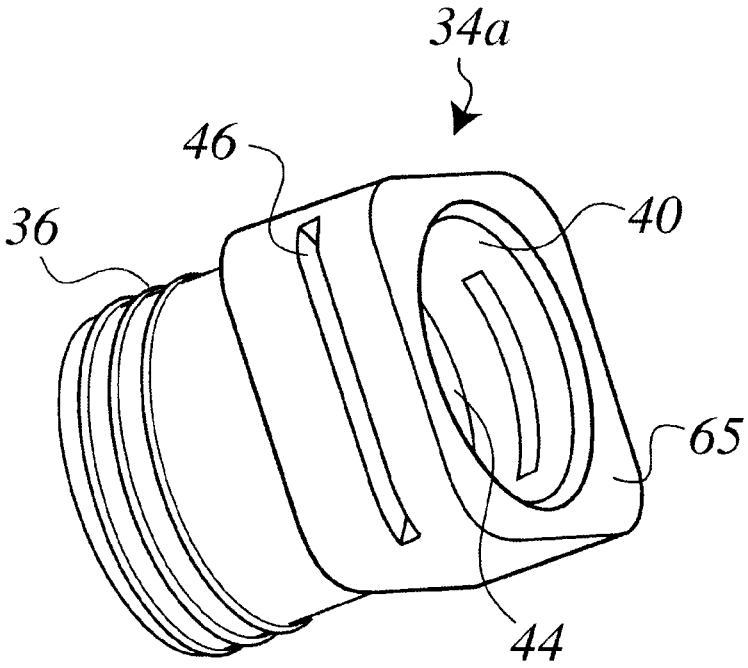
FIG. 6 is an enlarged perspective view of the spud component of an alternative preferred embodiment of the present invention.
Figure 7:
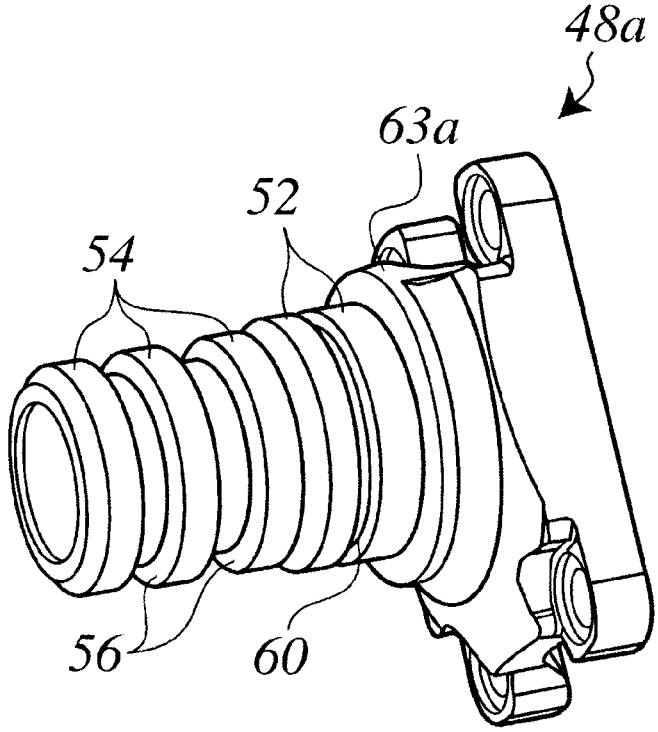
FIG. 7 is an enlarged perspective view of the shank component of the alternative embodiment, companion to the spud component shown in FIG. 6.

FIGS. 6 and 7 are enlarged perspective views of the spud 34*a* and shank 48*a* components of the another preferred embodiment of the present invention similar to the embodiment shown in FIG. 2. Clearly visible in FIG. 6 are the external threads 36 formed on the exterior surface of the spud 34*a* which are received in the internally threaded fitting 30 that is attached to the wall of the water heater 14. Also clearly visible are the two diametrically opposed slots 46 formed near the proximal end of the spud along with the various sections of the bore extending there through including the proximal section of increased diameter 40 and the chamfer 44 that steps the internal diameter of the bore down to that of the inner distal section. Absent from this preferred embodiment is the squared off lip 64 of the embodiment shown in FIGS. 2–5. Instead, a flat surface 65 defines the proximal end of the spud.

Visible in FIG. 7 are the features formed on the external surface of the shank 48*a* including the proximal section of increased diameter 52 and the distal section of reduced diameter 54. Formed in the distal section of reduced diameter are the two grooves 56 dimensioned to received the O-ring seals. The groove formed on the proximal section of increased diameter is dimensioned and positioned so as to receive a retainer clip 62 extending through the slots 46 in the spud 34*a* when fully shank is fully inserted into the spud. The base 63*a* of the shank 48*a* has a smooth circular surface that prevents rotational coupling with the proximal surface 65 of spud 34*a*.

In use, the shank 48*a* extending from controller 12 is simply pushed into the spud 34*a* that has previously been threaded onto a fitting that had in turn been attached to the wall of the water heater 14. The square cross-section of the external surface of the spud proximal to the threads allows a wrench to applied thereto enable sufficient torque to be applied thereto to form a water tight seal with the fitting. The positioning of the O-rings 58 on the shank rather than in the spud allows the O-rings to dimensioned so as to be in slight tension thereby serving to positively maintain them in place. Additionally, their position on the shank allows them to be readily inspected by the assembling technician for any damage and easily replaced if required. The increased internal diameter of the proximal section 40 of the spud, precludes contact between the O-rings 58 and slots 46 formed in the spud and thereby precludes any damage that may otherwise be inflicted by the edge of a slot on the soft seal material. As the shank is pushed further into the spud, the slight tension the O-rings are under ensures that their positions within their respective grooves are maintained as they become compressed by the chamfered step 44 between the spud's proximal section 40 and distal section 42. When the shank has been fully extended into the spud such that the proximal end 65 engages the opposing surface of the base 63*a* of the shank, the slots 46 in the spud will be aligned with the groove 60 formed in the proximal section of the shank. Insertion of the prongs 68 of clip 62 into the slots 46 serves to axially lock the shank to the spud to complete the assembly process. The flat surface 65 on the proximal end of the spud allows the controller to be rotated so as to accommodate rotational position of the spud. The bias of the prongs 68 toward one another maintain them in firm engagement with the base of the groove 60 while the interference of the inwardly direct prong ends 69 with the unslotted portion of the surface of the spud prevent the clip from inadvertently being dislodged. In the event it is necessary to subsequently remove the controller from the water heater, it is a simple matter of extracting the retainer spring clip 62 with the appropriate tool to release the shank from the spud. No damage to the spud, shank or O-rings occurs as a result of removal.

While a particular form of the invention has been illustrated and described, it will also be apparent to those skilled in the art that various modifications can be made without departing from the spirit and scope of the invention. Accordingly, it is not intended that the invention be limited except by the appended claims.

What is claimed is:

1. A coupling system for coupling a gas controller device to a water heater comprising:

a gas controller device including a shank extending therefrom and said shank having a first groove formed on its exterior surface;

a temperature sensor disposed within said shank;

a spud, configured for attachment to said water heater and having a bore formed therein configured to receive said shank, said spud having a slot formed there through to its bore, alignable with said groove on said shank; and a retainer element dimensioned to extend through said slot into said first groove so as to axially lock said shank to said spud;

whereby gas feedlines and electrical connectors may be connected to the gas controller device prior to coupling the gas controller device to the spud to evaluate the operable status of the gas controller device.

2. The coupling system of claim 1, wherein said shank has a second groove formed on its exterior surface and further comprising an O-ring configured for receipt in said second groove for forming a seal between said shank and said spud.

3. The coupling system of claim 2, wherein said shank has a distal section and a proximal section, wherein said distal section has a diameter less than that of said proximal section and wherein said first groove is formed on said proximal section and said second groove is formed on said distal section.

4. The coupling system of claim 3, wherein a said bore formed in said spud has a distal section and a proximal section, wherein said proximal section has an internal diameter greater than said distal section and wherein a transition between said proximal and distal section is chamfered.

5. The coupling system of claim 1, wherein said spud has a threaded section for receipt in a threaded fitting attached to said water heater.

6. The coupling system of claim 1, wherein said spud has an external surface proximal to said threaded section that is generally square in cross-section.

7. The coupling system of claim 1, wherein said spud and said shank have surfaces formed thereon that cooperate to prevent rotation of said shank relative to said spud upon full insertion of said shank into said spud.

8. The coupling system of claim 7, wherein said spud has a proximally extending lip formed about the outer periphery of its proximal end and said shank has a surface for receiving said lip.

9. The coupling system of claim 8, wherein said proximally extending lip is non-circular in cross-section.

10. The coupling system of claim 9, wherein said proximally extending lip is squared off and said shank has a squared off surface for engaging said lip.

11. The coupling system of claim 1, wherein all surfaces of said shank in contact with surfaces of said spud upon full insertion of said shank into said spud are formed so as to allow rotation of said shank relative to said spud.

12. The coupling system of claim 1, wherein said spud has two slots formed therein in a diametrically opposed orientation and wherein said retainer element is formed to simultaneously extend through both slots into said groove.

13. The coupling system of claim 12, wherein said retainer element has two prongs oriented to engage said diametrically opposed slots and wherein said prongs are biased toward a spacing less than the inner diameter of said shank within said first groove.

14. The coupling system of claim 13, wherein said retainer element is formed of wire spring material.

15. The coupling system of claim 13, wherein said prongs have ends formed so as to engage the outer surface of said spud to thereby prevent inadvertent dislodgement.

16. The coupling system of claim 1, wherein said temperature sensor comprises a bimetal device.

17. The coupling system of claim 3, wherein a third groove is formed in said distal section of said shank dimensioned to receive an O-ring for forming a second seal between said shank and said spud.

* * * * *